US011230020B2

(12) United States Patent
Odagiri

(10) Patent No.: US 11,230,020 B2
(45) Date of Patent: Jan. 25, 2022

(54) ROTARY ELECTRIC SHAVER

(71) Applicant: Maxell Izumi Co., Ltd., Matsumoto (JP)

(72) Inventor: Koichi Odagiri, Matsumoto (JP)

(73) Assignee: MAXELL IZUMI CO., LTD., Matsumoto (JP)

( * ) Notice: Subject to any disclaimer, the term of this patent is extended or adjusted under 35 U.S.C. 154(b) by 155 days.

(21) Appl. No.: 16/865,646

(22) Filed: May 4, 2020

(65) Prior Publication Data

US 2020/0384660 A1 Dec. 10, 2020

(30) Foreign Application Priority Data

Jun. 4, 2019 (JP) ..... JP2019-104582

(51) Int. Cl.
*B26B 19/14* (2006.01)

(52) U.S. Cl.
CPC ..... *B26B 19/145* (2013.01); *B26B 19/143* (2013.01)

(58) Field of Classification Search
CPC .... B26B 19/145; B26B 19/143; B26B 19/141
See application file for complete search history.

(56) References Cited

U.S. PATENT DOCUMENTS 6,460,252 B1 * 10/2002 Nakano ..... B26B 19/141 30/346.51
2007/0089298 A1 * 4/2007 Shimizu ..... B26B 19/14 30/43.6
2011/0030220 A1 * 2/2011 Shimizu ..... B26B 19/145 30/43.6
2013/0180112 A1 * 7/2013 Koike ..... B26B 19/145 30/43.5

FOREIGN PATENT DOCUMENTS

CA 2726798 A1 * 7/2011 ..... B26B 19/145
DE 1174651 B * 7/1964 ..... B26B 19/14
JP S55-158082 A 12/1980
JP S55-158083 A 12/1980

* cited by examiner

*Primary Examiner* — Jennifer S Matthews
(74) *Attorney, Agent, or Firm* — Manabu Kanesaka

(57) ABSTRACT

There is provided a rotary electric shaver which includes an external outer blade having a plurality of hair inlet holes on an annular shaving surface, an internal outer blade, a rotationally driven external inner blade having a plurality of small blades coming into sliding contact with a rear surface of the external outer blade, a rotationally driven internal inner blade, an external inner blade rest base, and an internal inner blade rest base. The external outer blade has a cylindrical guide ring formed on an inner peripheral side of an inner wall portion, and the external inner blade has a plurality of guides which come into sliding contact with an inner peripheral surface of the guide ring to perform radial alignment with respect to the external outer blade.

16 Claims, 6 Drawing Sheets

ROTARY ELECTRIC SHAVER

CROSS-REFERENCE TO RELATED APPLICATION

This application is based upon and claims the benefit of priority of the prior Japanese Patent Application No. P2019-104582, filed on Jun. 4, 2019, and the entire contents of which are incorporated herein by reference.

TECHNICAL FIELD

The present invention relates to a rotary electric shaver.

BACKGROUND ART

In the related art, a rotary electric shaver is known which includes an outer blade having a plurality of hair inlet holes on a shaving surface, and a rotationally driven inner blade having a plurality of small blades coming into sliding contact with a rear surface of the shaving surface. The rotary electric shaver cuts hairs entering the hair inlet holes by using the small blades (refer to PTL 1: JP-A-55-158082).

Here, in the rotary electric shaver disclosed as an example in PTL 1, the shaving surface of the outer blade is formed in an annular shape in a plan view. Accordingly, there is a disadvantage in that the hairs cannot be caught at a position radially inward of the shaving surface.

In contrast, a rotary electric shaver is disclosed which includes another shaving surface at the position radially inward of the shaving surface, in addition to the shaving surface having the annular shape in a plan view (refer to PTL 2: JP-A-55-158083). According to this configuration, compared to a configuration including only the annular shaving surface in a plan view, the hairs can also be caught at the position radially inward of the shaving surface. Therefore, picking ability of the hairs can be improved.

SUMMARY OF INVENTION

Technical Problem

However, the rotary electric shaver disclosed as an example in PTL 2 adopts the following configuration for alignment and support of a central outer blade disposed radially inward of the outer blade having the annular shaving surface and the inner blade to be combined with the central outer blade. Specifically, the configuration is adopted as follows. An outer blade stator is disposed at a radial center of the central outer blade, and an inner blade base is fixed to the outer blade stator so that both axes coincide with each other. According to this configuration, the axes of the central outer blade and the corresponding inner blade can coincide with each other. Therefore, hair cutting performance (hair cutting quality) can be favorably improved. On the other hand, the central outer blade is configured so that a recessed location for engaging the outer blade stator is disposed at a radial center position of the shaving surface. Therefore, there is the following disadvantage. Since the recessed location (that is, a recessed cavity) is present on the shaving surface of the central outer blade, a sense of touch is worsened, and an area for catching the hairs is reduced. There is another disadvantage in that a configuration is complicated due to the increased number of components and machining man-hours.

Solution to Problem

In response to the above issue, one or more aspects of the present invention are directed to a simply configured rotary electric shaver which can compatibly achieve favorable hair cutting quality and a favorable sense of touch when hairs are cut, and which can further improve picking ability and deep shaving ability.

In view of the above, the following embodiments are described below. In this invention, examples of the hairs include beards, mustache, whisker, and the like.

According to the disclosed embodiment, there is provided a rotary electric shaver including an external outer blade having a plurality of hair inlet holes on an annular shaving surface in a plan view, an internal outer blade having a plurality of hair inlet holes on a disk-shaped shaving surface in a plan view and arranged radially inward of the external outer blade, a rotationally driven external inner blade having a plurality of small blades coming into sliding contact with a rear surface of the shaving surface of the external outer blade, a rotationally driven internal inner blade having a plurality of small blades coming into sliding contact with a rear surface of the shaving surface of the internal outer blade, an external inner blade rest base to which the external inner blade is fixed, and an internal inner blade rest base to which the internal inner blade is fixed and which is supported by the external inner blade rest base. The external outer blade has a cylindrical guide ring integrally or separately formed on an inner peripheral side of an inner wall portion. The external inner blade has a plurality of guides which come into sliding contact with an inner peripheral surface of the guide ring so as to align with the external outer blade in the radial direction.

Advantageous Effects of Invention

According to the embodiment of the present invention, it is possible to compatibly achieve favorable hair cutting quality and a favorable sense of touch when hairs are cut, and it is possible to further improve picking ability and deep shaving ability. It is possible to realize a simple configuration having a small number of components and machining man-hours.

DESCRIPTION OF EMBODIMENTS

Figure 1:
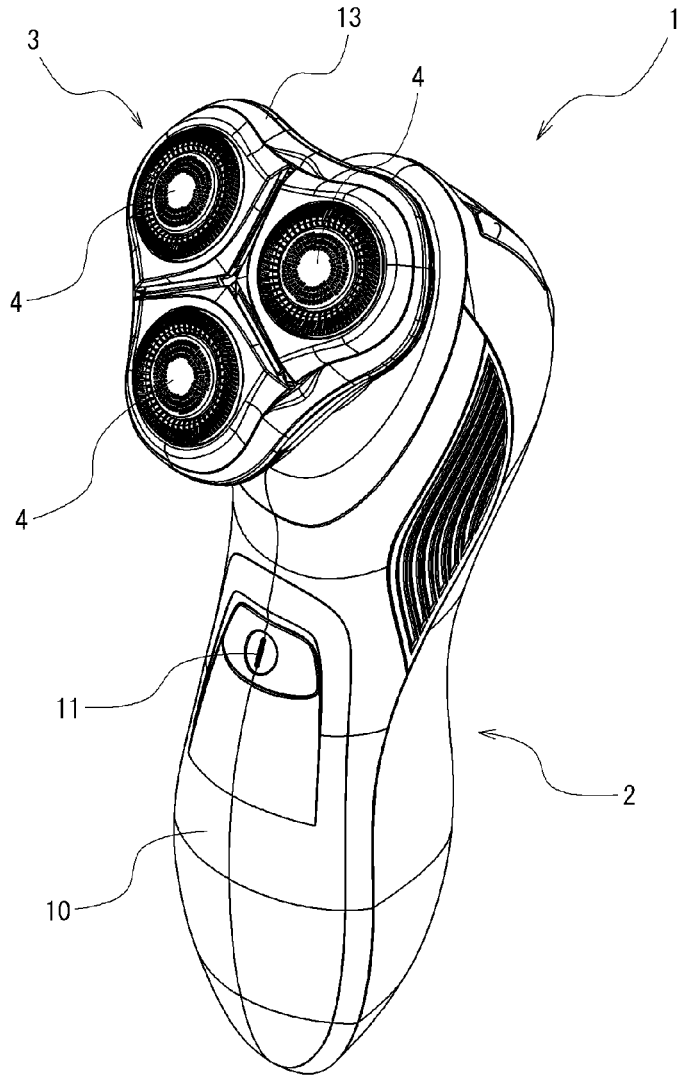
FIG. 1 is a schematic view (perspective view) illustrating an example of a rotary electric shaver according to an embodiment of the present invention.

Hereinafter, embodiments according to the present invention will be described in detail with reference to the drawings. FIG. 1 is a schematic view (perspective view) illustrating an example of a rotary electric shaver 1 according to the present embodiment. In all the drawings for describing the embodiments, the same reference numerals will be assigned to members having the same functions, and the repeated description thereof may be omitted in some cases.

Figure 2:
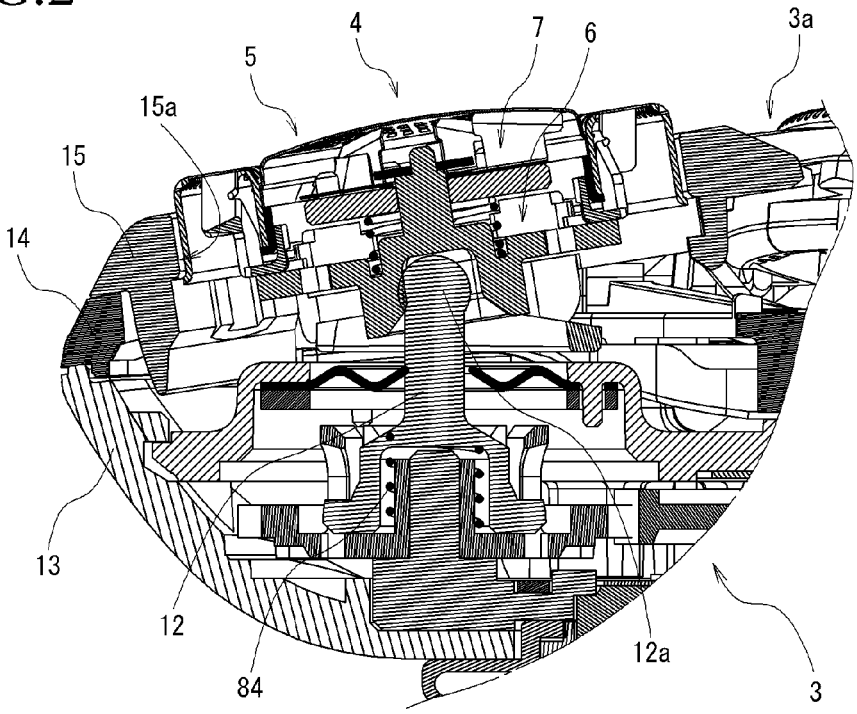
FIG. 2 is a schematic view (front sectional view) illustrating an example of a head unit of the rotary electric shaver illustrated in FIG. 1.
Figure 3:
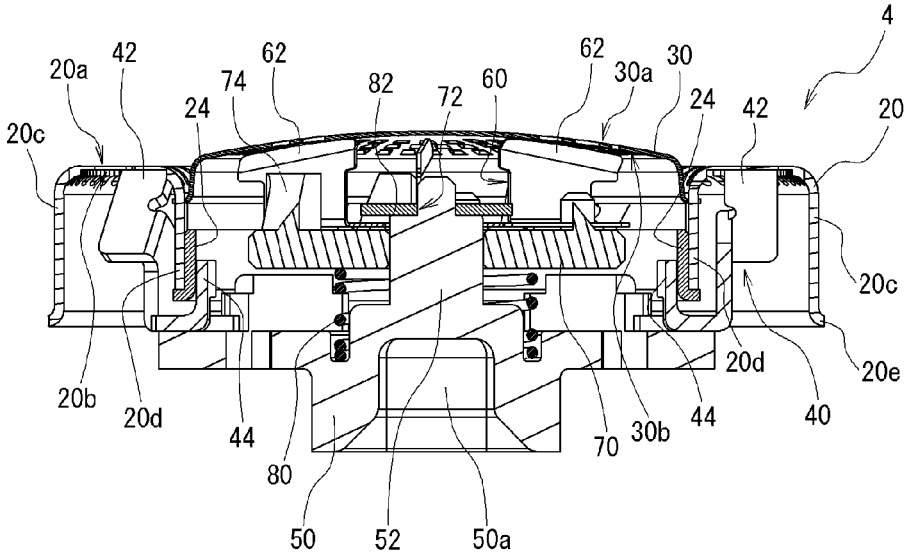
FIG. 3 is a schematic view (front sectional view) illustrating an example of a blade unit of the rotary electric shaver illustrated in FIG. 1.
Figure 4:
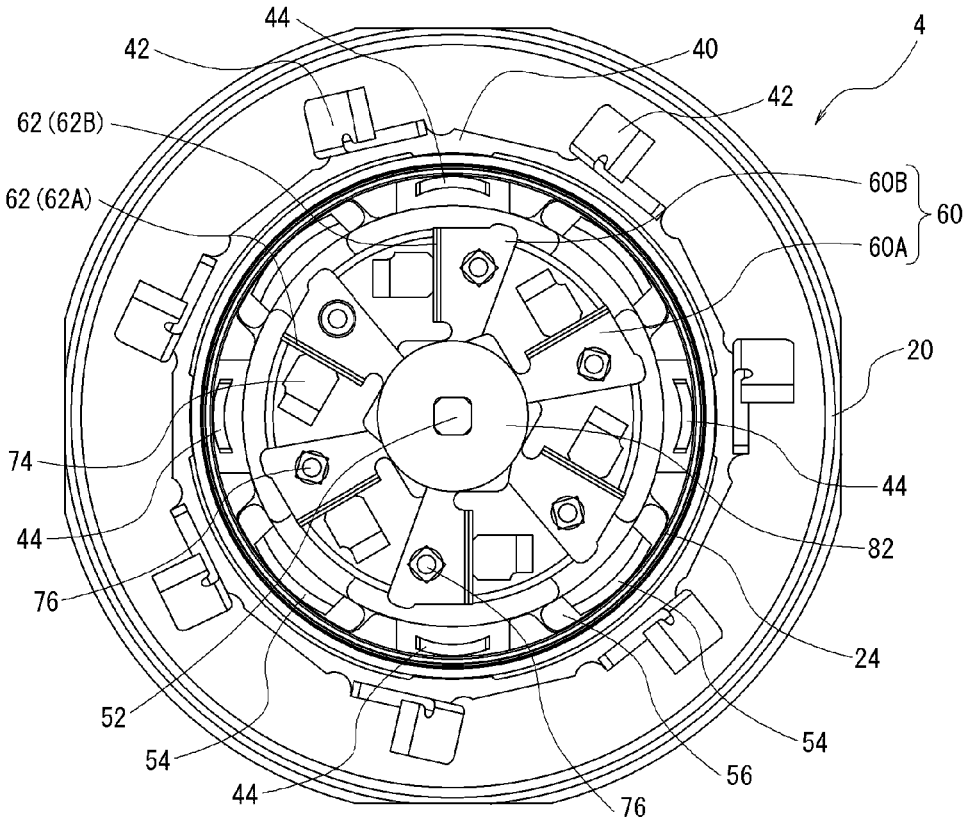
FIG. 4 is a schematic view (plan view) illustrating an example of the blade unit of the rotary electric shaver illustrated in FIG. 1.
Figure 5:
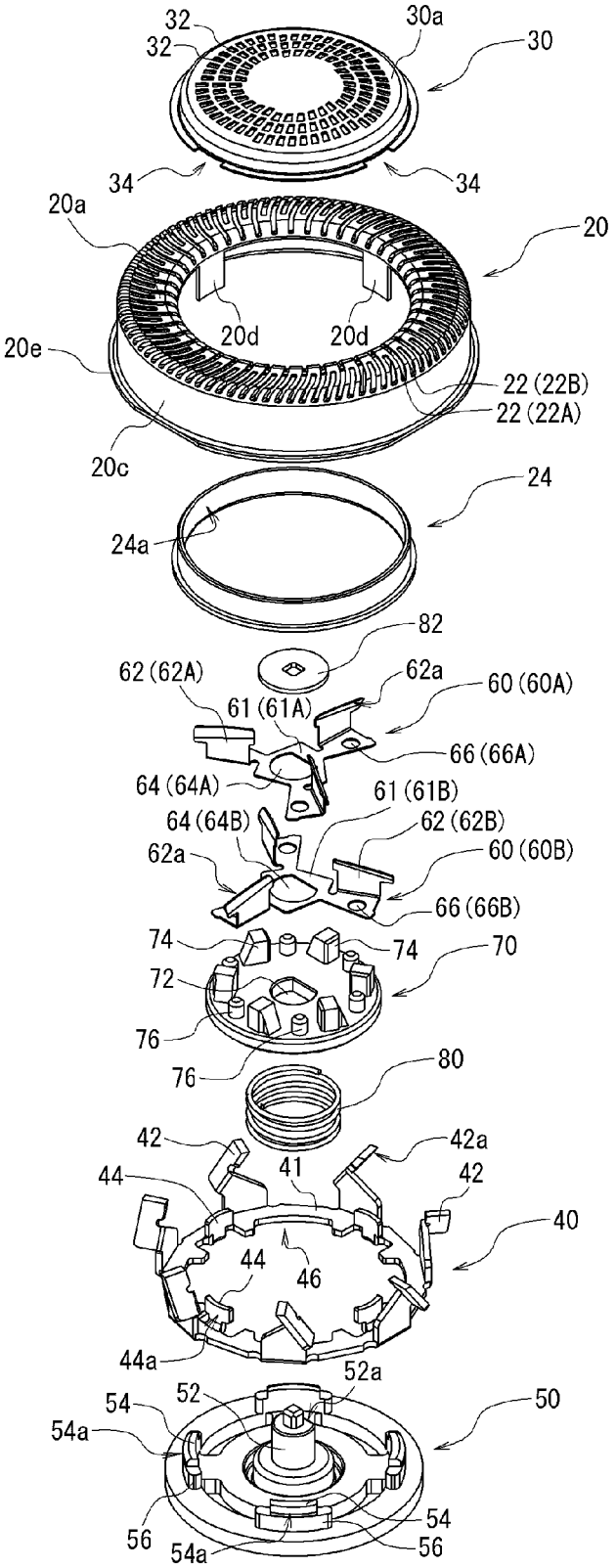
FIG. 5 is a schematic view (exploded perspective view) illustrating an example of the blade unit of the rotary electric shaver illustrated in FIG. 1.

As the rotary electric shaver 1 according to the present embodiment, as illustrated in FIG. 1, a configuration in which three sets of blade units 4 are arranged in a head unit 3 held by a main body 2 will be described as an example. The blade unit 4 according to the present embodiment is configured to include an outer blade set 5, an external inner blade set 6, and an internal inner blade set 7 (to be described later). Here, FIG. 2 illustrates a sectional view of the head unit 3 (sectional view in a portion of one blade unit 4). FIG. 3 illustrates a front sectional view (schematic view) of the blade unit 4. FIG. 4 illustrates a plan view (schematic view in which a shaving surface is not illustrated to facilitate understanding of an internal structure). FIG. 5 illustrates an exploded perspective view (schematic view). The present embodiment is an example in a case where three sets of blade units are provided. However, the present embodiment is not limited thereto.

First, the main body 2 includes a substantially columnar case 10. The case 10 internally accommodates a drive source (electric motor as an example), a battery, and a control circuit board (all not illustrated). A power switch 11 is attached to a front surface of the case 10.

Next, as illustrated in FIG. 2, the head unit 3 includes a head case 13 connected to and held by an upper portion of the case 10 of the main body 2, and an outer blade frame 14 fitted to the head case 13 from above, and an inner blade drive shaft 12 accommodated in an inner bottom portion of the head case 13. Furthermore, the head unit 3 includes three sets of an outer blade case 15 fitted to the outer blade frame 14 and a blade unit 4 held to be slightly movable and swingable in an axial direction with respect to the outer blade case 15. The three sets of the blade unit 4 are disposed in a triangular shape as an example. An axial movement amount of the blade unit 4 with respect to the outer blade case 15 (here, specified as an axial movement amount of the external outer blade 20) is set to approximately 0.5 to 1.5 mm, as an example.

In the present embodiment, the respective outer blade cases 15 are configured to be movable in a seesaw shape with respect to the outer blade frame 14 while interlocking with each other. In this manner, an upper surface 3*a* of the head unit 3 can deform between a convex surface state and a concave surface state.

Figure 6:
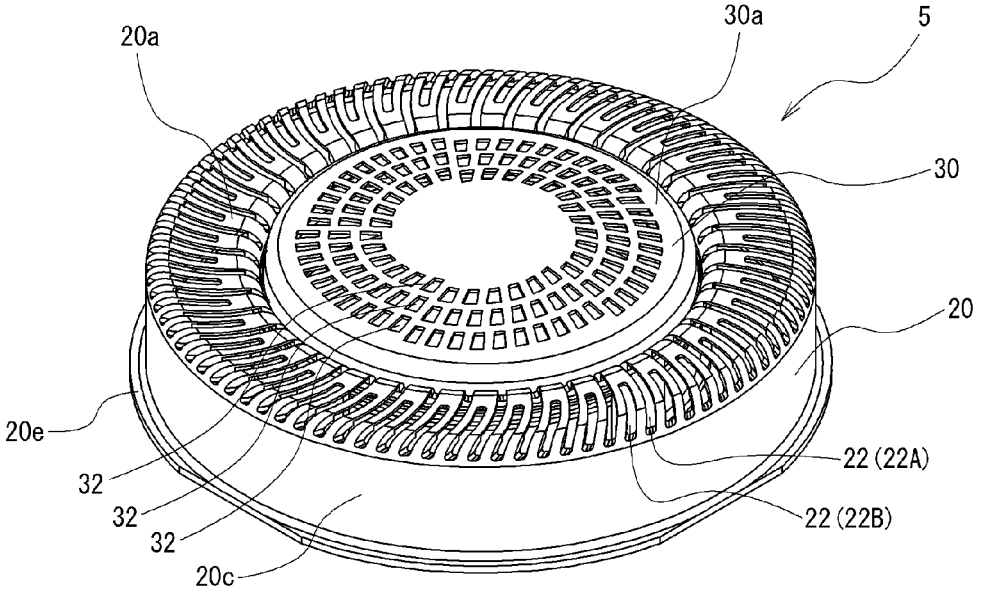
FIG. 6 is a schematic view (perspective view) illustrating an example of an outer blade set of the rotary electric shaver illustrated in FIG. 1.

Next, the outer blade set 5 in the blade unit 4 will be described. Here, FIG. 6 illustrates a perspective view (schematic view) of the outer blade set 5. As illustrated in FIGS. 5 and 6, the outer blade set 5 according to the present embodiment is configured to include an external outer blade 20 having a plurality of hair inlet holes (first hair inlet holes) 22 on an annular shaving surface 20 *a* in a plan view, and an internal outer blade 30 having a plurality of hair inlet holes (second hair inlet holes) 32 on a disk-shaped shaving surface 30*a* in a plan view and arranged radially inward of the external outer blade 20. As an example, the external outer blade 20 and the internal outer blade 30 are respectively formed as an integral structure (one component) by using a flat metal plate made of a stainless alloy and performing die cutting and bending using press working.

The external outer blade 20 according to the present embodiment is configured to have an outer wall portion 20*c* and an inner wall portion 20*d* which respectively extend downward from edge portions of the shaving surface 20*a*. The hair inlet hole (first hair inlet hole) 22 disposed on the shaving surface 20*a* is formed as a through-hole extending from the shaving surface 20*a* to a rear surface 20*b*. According to this configuration, it is possible to obtain an action of cutting the hairs entering the hair inlet hole 22 by interposing the hairs between a lower end portion thereof and a distal end portion (blade edge 42*a*) of the small blade 42 of the external inner blade 40. The hair inlet hole 22 can adopt various shapes such as a slit shape (elongated hole shape), a round hole shape, and a rectangular hole shape, or a combination thereof. As an example, a configuration is adopted as follows. A radially curved slit-shaped hole 22A extending from an inner edge to an outer edge of the shaving surface 20*a* and a radially curved slit-shaped hole 22B extending from the center to the outer edge of the shaving surface 20*a* are alternately aligned in a circumferential direction.

Here, as a characteristic configuration according to the present embodiment, the external outer blade 20 is configured so that the inner wall portion 20*d* is discontinuous in the circumferential direction, that is, to have a plate shape (planar or curved surface shape) disposed at a plurality of predetermined positions. Furthermore, a cylindrical guide ring 24 formed separately using a metal plate made of a stainless alloy engages with an inner peripheral side of the inner wall portion 20*d*. However, the present invention is not limited thereto. As a modification example, the guide ring 24 may be formed integrally with the external outer blade 20 (not illustrated).

On the other hand, the internal outer blade 30 according to the present embodiment is formed of one component using a metal material as described above, and is configured so that the shaving surface 30*a* is formed in a dome shape, that is, formed of a curved surface having a convex shape to the surface side and having no cavity (recessed portion) at the radial center. The hair inlet hole (second hair inlet hole) 32 disposed on the shaving surface 30*a* is formed as a through-hole extending from the shaving surface 30*a* to a rear surface 30*b*. According to this configuration, it is possible to obtain an action of cutting the hairs entering the hair inlet hole 32 by interposing the hairs between a lower end portion thereof and a distal end portion (blade edge 62*a*) of the small blade 62 of the internal inner blade 60. The hair inlet hole 32 can adopt various shapes such as a slit shape (elongated hole shape), a round hole shape, and a rectangular hole shape, or a combination thereof. As an example, rectangular hole-shaped (trapezoidal hole shape) hair inlet holes (second hair inlet holes) 32 are aligned in the circumferential direction in three rows in the radial direction.

An outer peripheral portion of the internal outer blade 30 has a cutout groove 34 engaging with the inner wall portion 20*d* of the external outer blade 20. That is, a configuration is adopted as follows. The inner wall portion 20*d* of the external outer blade 20 has a plate shape which is discontinuous in the circumferential direction, and the cutout groove 34 of the internal outer blade 30 engages with the inner wall portion 20*d*. According to this configuration, it is possible to realize a configuration in which the internal outer blade 30 is restricted not to move in the circumferential direction with respect to the external outer blade 20 and is movable in the axial direction.

Figure 7:
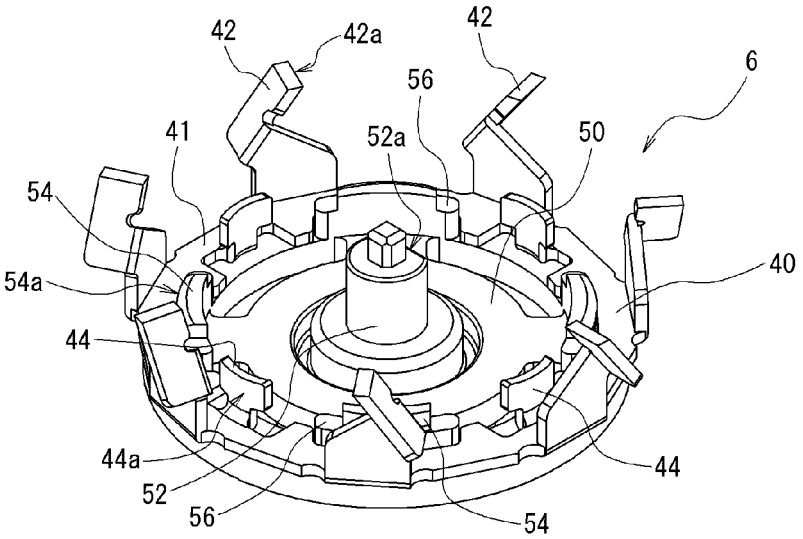
FIG. 7 is a schematic view (perspective view) illustrating an example of an external inner blade set of the rotary electric shaver illustrated in FIG. 1.
Figure 8:
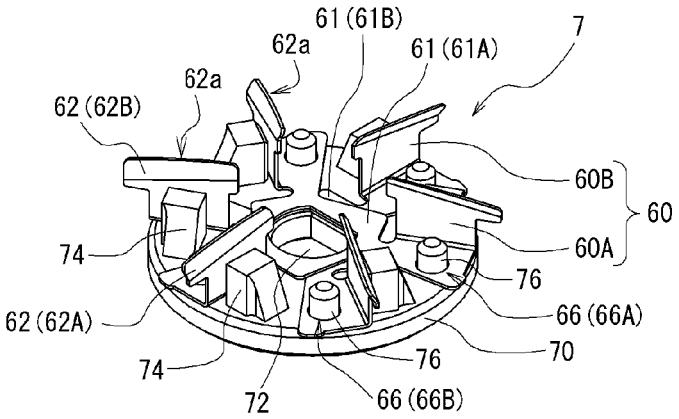
FIG. 8 is a schematic view (perspective view) illustrating an example of an internal inner blade set of the rotary electric shaver illustrated in FIG. 1.

Next, a configuration of the external inner blade set 6 and the internal inner blade set 7 in the blade unit 4 will be described. Here, FIG. 7 illustrates a perspective view (schematic view) of the external inner blade set 6, and FIG. 8 illustrates a perspective view (schematic view) of the internal inner blade set 7.

The external inner blade set 6 according to the present embodiment is configured to include a rotationally driven external inner blade 40 having a plurality of small blades (first small blades) 42 that come into sliding contact with the rear surface 20*b* of the shaving surface of the external outer blade 20, and an external inner blade rest base 50 to which the external inner blade 40 is fixed. As an example, the external inner blade 40 is formed as an integral structure (one component) by using a flat metal plate made of a stainless alloy and performing die cutting and bending using press working. The external inner blade rest base 50 is formed as an integral structure (one component) by using a resin material through molding. The external inner blade rest base 50 can also be formed by using a metal material.

Here, a structure for assembling the external inner blade 40 to the external inner blade rest base 50 is as follows. Specifically, a plurality of first projections 56 are erected on an upper surface of the external inner blade rest base 50. An inner periphery of the external inner blade 40 has an engagement groove 46 engaging with each of the first projections 56. Caulking (as an example, heat caulking) is performed in a state where the engagement groove 46 engages with the first projection 56. In this manner, the external inner blade rest base 50 and the external inner blade 40 are fixed to each other in a state where both axes coincide with each other.

The external inner blade 40 according to the present embodiment has a plurality of small blades (first small blades) 42 so that a portion of the base plate 41 formed of a substantially disk-shaped flat plate is erected on a plate surface (in order to simplify the drawing, the reference numerals are assigned to only some of the blades). As an example, the small blade (first small blade) 42 has a shape tilting toward a front side in the rotation direction, and an upper end edge on the front side in the rotation direction is the blade edge 42*a*.

The small blades (first small blades) 42 according to the present embodiment are formed to have the same radial width from an upper end to an intermediate portion. As an example, the radial width is approximately 1 to 3 mm. A circumferential width (plate thickness) is approximately 0.3 to 0.6 mm, and a height (axial height from a root to the blade edge) is approximately 3 to 5 mm. However, the size and the shape are not limited.

Here, as a characteristic configuration according to the present embodiment, in the external inner blade 40, a plurality of guides 44 coming into sliding contact with the inner peripheral surface 24*a* of the guide ring 24 disposed in the external outer blade 20 are disposed at an equal interval in the circumferential direction. The guide 44 according to the present embodiment is formed so that a portion of the base plate 41 is erected and curved on the plate surface. According to this configuration, the plurality of guides 44 come into sliding contact with the inner peripheral surface 24*a* of the guide ring 24. In this manner, the external inner blade 40 can align with the external outer blade 20 in the radial direction. That is, the axes of the external outer blade 20 and the external inner blade 40 can coincide with each other. The external outer blade 20 and the external inner blade 40 are sharpened at a position where the axes coincide with each other so that hair cutting performance (hair cutting quality) is optimized. Therefore, the hair cutting performance (hair cutting quality) can be continuously achieved in an optimized state.

On the other hand, the above-described alignment structure adopts a configuration in which the blades slide at a position closer to the outer periphery in the radial direction, compared to a configuration in which the blades slide at the radial center as disclosed in PTL 2. Therefore, a sliding speed (peripheral speed) increases, thereby causing a disadvantage in that the amount of heat generated due to friction increases.

The guide 44 according to the present embodiment solves the disadvantage by adopting the following configuration. Specifically, instead of a configuration in which the blades come into contact with the entire surface facing the inner peripheral surface 24*a* of the guide ring 24, a configuration is adopted to have a contact portion 44*a* formed in a curved surface shape for point contact, line contact, or surface contact. According to this configuration, e sliding resistance between the guide 44 and the guide ring 24 can be reduced. Therefore, the amount of heat generated during use can be suppressed, and power consumption and noise can be reduced.

Next, a lower portion of the external inner blade rest base 50 has a recess 50*a* with which an upper end of the inner blade drive shaft 12 engages. The upper end of the inner blade drive shaft 12 enters the recess 50*a* from below, and engages with the recess 50*a* to be swingable, thereby transmitting driving power. However, the engagement structure is an example, and another joint structure may be adopted (not illustrated). An upper portion of the external inner blade rest base 50 has an engagement projection 52 with which an internal inner blade rest base 70 (to be described later) engages at a radial center position. The engagement projection 52 is formed in a shape having a flat portion 52*a* parallel to the axial direction on the outer peripheral surface. As an example, a cross section orthogonal to the axial direction has a D-shape. However, without being limited thereto, the cross section may be a polygonal shape (not illustrated).

A plurality of auxiliary guides 54 coming into sliding contact with the inner peripheral surface 24*a* of the guide ring 24 disposed in the external outer blade 20 are disposed at an equal interval in the circumferential direction in the external inner blade rest base 50. According to this configuration, the plurality of auxiliary guides 54 come into sliding contact with the inner peripheral surface 24*a* of the guide ring 24. In this manner, the external inner blade rest base 50 can align with the external outer blade 20 in the radial direction. That is, the axes of the external outer blade 20 and the external inner blade rest base 50 can coincide with each other.

As an example, as in the above-described guide 44, instead of a configuration in which the blades come into contact with the entire surface facing the inner peripheral surface 24*a* of the guide ring 24, the auxiliary guide 54 adopts a configuration having a contact portion 54*a* formed in a curved surface shape for point contact, line contact, or surface contact. According to this configuration, sliding resistance between the auxiliary guide 54 and the guide ring 24 can be reduced. Therefore, the amount of heat generated during use can be suppressed, and power consumption and noise can be reduced.

Next, the internal inner blade set 7 according to the present embodiment is configured to include the rotationally driven internal inner blade 60 having the plurality of small blades (second small blades) 62 coming into sliding contact with the rear surface 30*b* of the shaving surface of the internal outer blade 30, and the internal inner blade rest base 70 to which the internal inner blade 60 is fixed. Here, the internal inner blade 60 is configured as follows. A first inner blade 60A and a second inner blade 60B overlap each other in the axial direction so that the base plates (that is, 61A and 61B) are in contact with each other. As an example, the first inner blade 60A and the second inner blade 60B are respectively formed as an integral structure (one component) by using a flat metal plate made of a stainless alloy and performing die cutting and bending using press working. The internal inner blade rest base 70 is formed as an integral structure (one component) by using a resin material through molding. The internal inner blade rest base 70 can also be formed by using a metal material.

Here, a structure for assembling the internal inner blade 60 to the internal inner blade rest base 70 is as follows. Specifically, a plurality of second projections 76 are erected on an upper surface of the internal inner blade rest base 70. Each of the first inner blade 60A and the second inner blade 60B has fitting holes 66 (66A, 66B) to be fitted to the respective second projections 76. Caulking (as an example, heat caulking) is performed in a state where the fitting holes 66 (66A, 66B) respectively engage with the second projections 76. In this manner, the internal inner blade rest base 70 and the internal inner blade 60 (that is, the first inner blade 60A and the second inner blade 60B) are fixed to each other in a state where both axes coincide with each other.

The first inner blade 60A according to the present embodiment has a plurality of (as an example, three) small blades (second small blades) 62 (62A) so that a portion of the base plate 61 (61A) formed of a substantially disk-shaped flat plate is erected on a plate surface (in order to simplify the drawing, the reference numerals are assigned to only some of the small blades). As an example, the small blade (second small blade) 62A has a shape in which the upper portion is bent toward the front side in the rotation direction and is inclined, and the upper end edge on the front side in the rotation direction becomes the blade edge 62*a*. Similarly, the second inner blade 60B has a plurality of (as an example, three) small blades (second small blades) 62 (62B) so that a portion of the base plate 61 (61B) formed of a substantially disk-shaped flat plate is erected on a plate surface (in order to simplify the drawing, the reference numerals are assigned to only some of the small blades). As an example, the small blade (second small blade) 62B has a shape in which the upper portion is bent and tilted toward the front side in the rotation direction, and the upper end edge on the front side in the rotation direction is the blade edge 62*a*.

The small blades (second small blades) 62 (62A and 62B) according to the present embodiment are formed so that the upper portion has a larger radial width than the lower portion. As an example, the radial width is approximately 3 to 4 mm, the circumferential width (plate thickness) is approximately 0.1 to 0.2 mm, and the height (axial height from the root to the blade edge) is approximately 2 to 3 mm. However, the size and the scope are not limited thereto.

In this way, the internal inner blade 60 is configured using two of the first inner blade 60A and the second inner blade 60B. Accordingly, compared to a case where the internal inner blade 60 is configured using only one of the two blades, the number of the small blades (second small blades) 62 can be increased while the required height of the small blades (second small blades) 62 is secured. Therefore, hair cutting performance, specifically, deep shaving ability can be further improved, and a shaving time can be shortened. The required height of the small blades (second small blades) 62 is secured. Accordingly, an axial movement structure (to be described later) of the internal outer blade 30 and the internal inner blade 60 can be realized.

Next, the engagement hole 72 is disposed at the radial center position of the internal inner blade rest base 70. In the present embodiment, the engagement hole 72 of the internal inner blade rest base 70 engages with the engagement projection 52 of the external inner blade rest base 50 with a predetermined gap (fitting dimension). Here, a first biasing member 80 (as an example, a coil spring) contracting between the lower surface of the internal inner blade rest base 70 and the upper surface of the external inner blade rest base 50 is arranged. According to this configuration, a structure is realized in which the internal inner blade rest base 70 is supported to be movable in the axial direction by the external inner blade rest base 50 while the internal inner blade rest base 70 receives an upward biasing force.

In this case, the engagement hole 72 is formed in the same shape (D-shape in the present embodiment) as the cross-sectional shape of the above-described engagement projection 52. In this manner, the rotational driving power transmitted from the inner blade drive shaft 12 to the external inner blade rest base 50 can be further transmitted to the internal inner blade rest base 70. The insertion holes 64 (64A, 64B) disposed in the first inner blade 60A and the second inner blade 60B are disposed in order to insert the engagement projection 52, and are configured not to come into contact with the engagement projection 52.

Furthermore, the internal inner blade rest base 70 to which the internal inner blade 60 is fixed is biased upward by the first biasing member 80, and is configured so that a stopper 82 is attached to a distal end of the engagement projection 52 in a state where the internal inner blade rest base 70 engages with the external inner blade rest base 50. According to this configuration, the internal inner blade rest base 70 is prevented from being detached from the external inner blade rest base 50, thereby specifying an upper limit position in the axial movement. The axial movement amount of the external inner blade rest base 50 with respect to the internal inner blade rest base 70 (that is, specified as the axial movement amount of the external inner blade 40 with respect to the external outer blade 20) is set to approximately 0.5 to 1 mm, as an example. In this way, a configuration is realized in which the external inner blade 40 is movable in the axial direction with respect to the external outer blade 20. Accordingly, followability (close contact ability) to the skin can be improved when in use. Therefore, it is possible to compatibly achieve favorable hair cutting quality and a favorable sense of touch when hairs are cut, and it is possible to further improve picking ability and deep shaving ability.

The internal inner blade rest base 70 is configured to have a rear support projection 74 projecting to come into contact with a rear-side surface in the rotation direction of the small blades (second small blades) 62 (62A, 62B). According to this configuration, the small blades (second small blades) 62 (62A, 62B) can be prevented from being deformed after being bent rearward in the rotation direction when in use. Therefore, the internal outer blade 30 can be formed of a thinner metal material. The blade edge 62*a* coming into sliding contact with the rear surface 30*b* of the shaving surface of the internal outer blade 30 can be always maintained at an optimum angle. Therefore, the hair cutting performance (hair cutting quality) can be continuously achieved in an optimized state.

In addition to this configuration, when the internal outer blade 30, that is, the small blades (second small blades) 62 (62A, 62B) can be formed to be thin, an area coming into sliding contact with the rear surface 30*b* of the shaving surface is reduced, and the amount of heat generated by the sliding contact can be reduced. Therefore, the radial width of the small blades (second small blades) 62 (62A, 62B) can be formed to be wider. Therefore, on the shaving surface 30*a* of the internal outer blade 30, the hair inlet hole (second hair inlet hole) 32 can be disposed to a position closer to the radial center. As a result, the hair cutting performance can be improved. Specifically, the picking ability and the deep shaving ability can be further improved, and the shaving time can be shortened. At the same time, the cost of components can be reduced and the press working can be facilitated by adopting a thin metal material.

As described above, the rotary electric shaver in the related art disclosed as an example in PTL 2 is configured as follows. For alignment and support of the outer blade and the inner blade, the cavity for engaging the outer blade stator is disposed in the central outer blade. As a result, since the cavity is present, there is a disadvantage in that a sense of touch is worsened and an area for catching the hairs is reduced. There is another disadvantage in that a configuration is complicated due to the increased number of components and machining man-hours.

On the other hand, according to the present embodiment, the external inner blade 40 aligns with the external outer blade 20 in the radial direction. Accordingly, without providing the outer blade stator, the alignment can be realized by adopting a configuration in which the plurality of guides 44 of the external inner blade 40 are brought into sliding contact with the guide ring 24 of the external outer blade 20. According to this configuration, it is possible to realize the internal outer blade 30 which is formed of one component in which the shaving surface 30*a* has a curved surface having a convex shape to the surface side and having no cavity at the radial center, and which is movable in the axial direction. Therefore, it is possible to solve the above-described disadvantage. That is, it is possible to compatibly achieve favorable hair cutting quality and a favorable sense of touch when hairs are cut, and it is possible to further improve picking ability and deep shaving ability. It is possible to realize a simple configuration having a small number of components and machining man-hours.

According to the present embodiment, in addition to a configuration in which the plurality of guides 44 are disposed in the external inner blade 40, a configuration is adopted in which the plurality of auxiliary guides 54 are disposed in the external inner blade rest base 50. According to this configuration, the external inner blade 40 rotationally driven in a state of being fixed to the external inner blade rest base 50 and coming into sliding contact with the external outer blade 20 can more accurately align with the external outer blade 20 so that the axes coincide with each other. Therefore, smoother rotation can be realized, and the hair cutting performance (hair cutting quality) can be more favorably improved. As an example, the guides 44 and the auxiliary guides 54 are alternately disposed at an equal interval in the circumferential direction.

Next, the inner blade drive shaft 12 is a component that is formed of a resin material and transmits the driving power of a drive source (here, an electric motor) to rotationally drive the external inner blade rest base 50. The upper end of the inner blade drive shaft 12 according to the present embodiment has a transmission portion 12*a* that engages with the recess 50*a* of the external inner blade rest base 50 to transmit the driving power. As an example, the transmission portion 12*a* and the recess 50*a* may have any desired shape such as a polygonal shape or an elliptical shape in a plan view, as long as both of these can engage with each other to transmit the driving power.

The inner blade drive shaft 12 is configured so that a second biasing member (as an example, a coil spring) 84 is internally contracted to generate a biasing force in an expanding direction. The biasing force is a pressing force that presses the external inner blade 40 against the external outer blade 20 and further presses the external outer blade 20 against the outer blade case 15. In this case, a flange-shaped portion 20*e* disposed in a lower end of the outer wall portion 20*c* of the external outer blade 20 functions as a stopper locked to a lower end of the inner wall portion 15*a* of the outer blade case 15.

As described above, according to the rotary electric shaver in the present invention, it is possible to compatibly achieve favorable hair cutting quality and a favorable sense of touch when hairs are cut, and it is possible to further improve picking ability and deep shaving ability. It is possible to realize a simple configuration having a small number of components and machining man-hours.

The present invention is not limited to the embodiments described above, and various modifications can be made within the scope not departing from the present invention. In particular, the rotary electric shaver including three sets of the blade unit has been described as an example. However, without being limited thereto, a configuration having the number of different sets may be adopted. Even in a case where the number of the blade units is other than three, a basic configuration may be conceivable as in the above-described example.

The rotary electric shaver including one row of the annular shaving surfaces in the external outer blade has been described as an example. However, without being limited thereto, a configuration including a plurality of rows may be adopted.

What is claimed is:

1. A rotary electric shaver comprising:

an external outer blade having a plurality of hair inlet holes on an annular shaving surface in a plan view;

an internal outer blade having a plurality of hair inlet holes on a disk-shaped shaving surface in a plan view and disposed radially inward of the external outer blade;

a rotationally driven external inner blade having a plurality of small blades coming into sliding contact with a rear surface of the shaving surface of the external outer blade;

a rotationally driven internal inner blade having a plurality of small blades coming into sliding contact with a rear surface of the shaving surface of the internal outer blade;

an external inner blade rest base to which the external inner blade is fixed; and an internal inner blade rest base to which the internal inner blade is fixed and which is supported by the external inner blade rest base, wherein the external outer blade has a cylindrical guide ring integrally or separately formed on an inner peripheral side of an inner wall portion, and the external inner blade has a plurality of guides which come into sliding contact with an inner peripheral surface of the guide ring to perform radial alignment with respect to the external outer blade.

2. The rotary electric shaver according to claim 1, wherein the external inner blade rest base has an engagement projection at a radial center, and the internal inner blade rest base has an engagement hole at a radial center, and in a state where the engagement hole engages with the engagement projection, the internal inner blade rest base is supported to be axially movable with a biasing member interposed therebetween by the external inner blade rest base.

3. The rotary electric shaver according to claim 2, wherein the internal outer blade is formed of one component, and the shaving surface is formed in a curved surface having a convex shape and no cavity at the radial center.

4. The rotary electric shaver according to claim 3, wherein the internal inner blade is configured so that small blades of a first inner blade and a second inner blade that are in sliding contact with the internal outer blade are erected at a predetermined position of respective base plates and overlap each other in an axial direction so that the base plates come into contact with each other.

5. The rotary electric shaver according to claim 3, wherein in the external outer blade, the inner wall portion is discontinuously formed at a plurality of positions in a circumferential direction, and an outer peripheral portion of the internal outer blade has a cutout groove which engages with the inner wall portion and restricts a circumferential movement with respect to the external outer blade.

6. The rotary electric shaver according to claim 3, wherein the internal inner blade rest base has a rear support projection which contacts a rear-side surface of the small blades in a rotation direction when the small blades are in sliding contact with the internal outer blade.

7. The rotary electric shaver according to claim 2, wherein the internal inner blade is configured so that small blades of a first inner blade and a second inner blade that are in sliding contact with the internal outer blade are erected at a predetermined position of respective base plates and overlap each other in an axial direction so that the base plates come into contact with each other.

8. The rotary electric shaver according to claim 2, wherein in the external outer blade, the inner wall portion is discontinuously formed at a plurality of positions in a circumferential direction, and an outer peripheral portion of the internal outer blade has a cutout groove which engages with the inner wall portion and restricts a circumferential movement with respect to the external outer blade.

9. The rotary electric shaver according to claim 2, wherein the internal inner blade rest base has a rear support projection which contacts a rear-side surface of the small blades in a rotation direction when the small blades are in sliding contact with the internal outer blade.

10. The rotary electric shaver according to claim 1, wherein the internal outer blade is formed of one component, and the shaving surface is formed in a curved surface having a convex shape and no cavity at the radial center.

11. The rotary electric shaver according to claim 10, wherein the internal inner blade is configured so that small blades of a first inner blade and a second inner blade that are in sliding contact with the internal outer blade are erected at a predetermined position of respective base plates and overlap each other in an axial direction so that the base plates come into contact with each other.

12. The rotary electric shaver according to claim 10, wherein in the external outer blade, the inner wall portion is discontinuously formed at a plurality of positions in a circumferential direction, and an outer peripheral portion of the internal outer blade has a cutout groove which engages with the inner wall portion and restricts a circumferential movement with respect to the external outer blade.

13. The rotary electric shaver according to claim 10, wherein the internal inner blade rest base has a rear support projection which contacts a rear-side surface of the small blades in a rotation direction when the small blades are in sliding contact with the internal outer blade.

14. The rotary electric shaver according to claim 1, wherein the internal inner blade is configured so that small blades of a first inner blade and a second inner blade that are in sliding contact with the internal outer blade are erected at a predetermined position of respective base plates and overlap each other in an axial direction so that the base plates come into contact with each other.

15. The rotary electric shaver according to claim 1, wherein in the external outer blade, the inner wall portion is discontinuously formed at a plurality of positions in a circumferential direction, and an outer peripheral portion of the internal outer blade has a cutout groove which engages with the inner wall portion and restricts a circumferential movement with respect to the external outer blade.

16. The rotary electric shaver according to claim 1, wherein the internal inner blade rest base has a rear support projection which contacts a rear-side surface of the small blades in a rotation direction when the small blades are in sliding contact with the internal outer blade.

* * * * *